United States Patent [19]

Arduin et al.

[11] Patent Number: 4,759,565

[45] Date of Patent: Jul. 26, 1988

[54] MONOSKI BRAKE

[75] Inventors: Joel Arduin, Annecy le Vieux; Pierre Feche, Annecy, both of France

[73] Assignee: Salomon S.A., Annecy, France

[21] Appl. No.: 23,226

[22] Filed: Mar. 9, 1987

[30] Foreign Application Priority Data

Mar. 10, 1986 [FR] France ..... 86 03855

[51] Int. Cl.[4] ..... A63C 7/10

[52] U.S. Cl. ..... 280/605

[58] Field of Search ..... 280/605, 607, 617, 618, 280/12 AB, 604

[56] References Cited

U.S. PATENT DOCUMENTS

| | | | |
|---|---|---|---|
| 3,947,049 | 3/1976 | Pedersen | 280/607 X |
| 4,227,714 | 10/1980 | Riedel | 280/605 |
| 4,463,967 | 8/1984 | Klubitschko | 280/605 |

FOREIGN PATENT DOCUMENTS

| | | |
|---|---|---|
| 0045698 | 8/1981 | European Pat. Off. . |
| 2920981 | 11/1980 | Fed. Rep. of Germany . |
| 2480610 | 10/1981 | France . |

*Primary Examiner*—John J. Love
*Assistant Examiner*—Michael Mar
*Attorney, Agent, or Firm*—Sandler & Greenblum

[57] ABSTRACT

A monoski brake comprising:

(a) a plurality of brake elements each adapted to assume an active position in which they each extend downwardly below the lower plane of the monoski, and an inactive position in which they are each at a level above the lower plane of the monoski;

(b) inactivation apparatus for inactivating all of the brake elements by moving the brake element from the active position to the inactive position; and wherein the inactivation apparatus is adapted to inactivate more than one of the brake elements simultaneously.

17 Claims, 3 Drawing Sheets

Fig.1
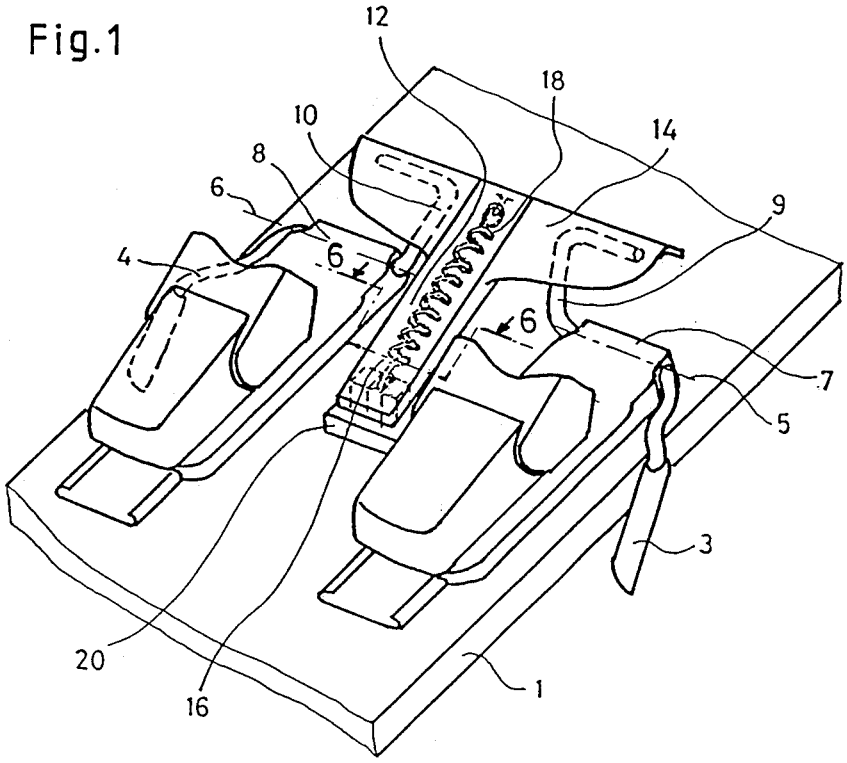
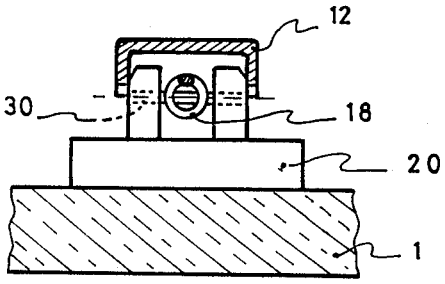
Fig. 6
Fig. 7
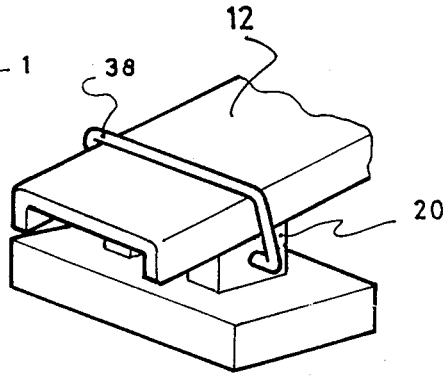

MONOSKI BRAKE

BACKGROUND OF THE INVENTION

1. Field of the Invention

The present invention relates to snow monoski brake apparatus.

2. Description of Background and Relevant Information

In the field of conventional skis (one ski per foot) safety straps have, for the most part, been abandoned in favor of ski brakes. The brake apparatus generally comprises two brake elements which, during a release of the binding, are made to project by means of an elastic apparatus beneath the lower surface of the ski to stop the ski from sliding. When the boot is re-inserted into the binding, the action of the boot or shoe on the pedal raises the brake element to allow skiing to continue without interference.

The present diversification of snow sports has caused an increased interest in monoskis which consist of a relatively wide ski on which the two feet of the skier are positioned side-by-side, or slightly offset relative to one another.

On a monoski, two separate bindings of the same type as that which are currently utilized on each of the skis of a pair of skis are both mounted on the monoski. By analogy, brake systems which are identical to those used on conventional ski pairs are utilized, with each foot activating its own brake. The brakes are modified as contrasted to the conventional configuration such that one of the brake projections is eliminated while leaving in position only the exterior brake projection, by removing the brake projection which would otherwise be positioned in the middle of the monoski. This direct modification of the technology utilized with ski pairs to the monoski concept has numerous disadvantages including:

(1) Although when monoskis first appeared such a design appeared economically viable because one avoided the manufacture of specially designed brakes for monoskis on a small scale, economics have now changed given the increased scale of manufacture of monoskis now occurring because of the increased popularity of this type of skiing;

(2) Monoskis have a greater weight and width than a conventional ski. Consequently, the return forces which normally bias the brake projection beneath the lower surface of the ski become insufficient to brake the ski. Simply increasing these return forces to adapt the breaking system to a monoski does not overcome the problem because the resulting systems require that an excessive force be applied when the boot is inserted within the binding to lift the brake projections. As a further consequence of such a design, this substantial return force, even if it can be overcome by the skier when he places his boot in his binding, is dangerous from a safety point of view because the vertical force exerted interferes with the appropriate operation of the safety binding.

(3) Having two independent brakes, each activated by separate monoski bindings, results in the braking system of one side or the other being activated as soon as the skier removes one of his feet from one of the bindings on the monoski. This is a particular disadvantage because a skier may sometimes purposely remove one of his boots from one of his bindings, such as when the skier is about to use a ski lift, while still maintaining the other boot in its binding so as to be able to advance on a lift line by walking with his free foot so as to propel the ski along. In this type of situation it would be desirable if no brake would be activated so as to interfere.

SUMMARY OF THE INVENTION

According to the invention a monoski brake is provided which comprises:

(a) at least one brake element adapted to assume an active position in which it extends downwardly below the lower plane of the monoski, and an inactive position in which it is at a level above the lower plane of the ski;

(b) inactivation means for inactivating the brake element by moving the brake element from the active position to the inactive position; and wherein the inactivation means is adapted to inactivate more than one of the brake elements simultaneously.

The monoski brake preferably comprises a plurality of brake elements, and the inactivation means is adapted to inactivate all of the plurality of brake elements simultaneously.

The monoski brake is used in combination with a pair of ski bindings adapted to be mounted on the monoski, with each of the brake elements being associated with one of the bindings. The inactive means is associated with both of the bindings whereupon insertion of one boot into one of the bindings results in the brake elements associated with both of the bindings being inactivated. Each of the brake elements comprises a brake projection, and a head, and is adapted to pivot around a pivot axis. The head moves in a plane substantially perpendicular to that of the monoski on which the combination is to be mounted wherein in the active position the projection projects beneath the lower plane of the monoski and in the inactive position the projection is raised to at least the plane of the monoski, while the heads are adapted to remain above the upper surface of the monoski.

The monoski brake-binding combination comprises bias means for biasing each of the brake elements towards the active position.

The inactivation means is most preferably a common pedal associated with each of the heads of the brake elements. The common pedal comprises a frontal portion extending across the vertical longitudinal median plane of the monoski into zones to be occupied by each of the ski boots, whereby both of the brake elements are activated simultaneously only upon removal of both boots. The bias means comprise at least one spring attached at one end to the lower surface of the frontal portion of the pedal and at its other end to a stud adapted to be attached to the upper surface of the monoski on the side opposite the head with respect to the pivot axis. Each of the springs is attached to the central zone of the frontal portion of the pedal.

The pedal further comprises a rear central portion slidably mounted on the stud. The stud and rear portion of the pedal may comprise complementary engagement means adapted to assure guidance of the rear central portion of the pedal.

The heads are most preferably mounted to slide transversely in a fold in the frontal portion of the pedal whereby the braking elements may be positioned at variable lateral distances relative to the pedal as a function of the width of the monoski.

Sockets are provided which are adapted to be laterally affixed on the upper surface of the monoski for receiving the pivot axes.

In one embodiment the brake elements may comprise an intermediate element constituting the pivot axis for the brake element. The intermediate portion extends through one of the sockets, and each of the brake elements is angled on both sides of their intermediate portion to press against the lateral surfaces of the sockets so as to assure their transverse guidance.

The brake elements may further comprise bends defining at oblique segment between the brake projection and the intermediate portion which is obliquely oriented when the brake projection is in the inactive position, such that the brake projection is lifted with respect to the surface of the ski.

According to one embodiment each of the sockets is adapted to form a support surface on which the sole of a boot may rest.

In one preferred embodiment each of the brake elements is mounted on a socket, and each of the inactivation means comprises a pedal; and the two brake elements, their corresponding sockets, and the pedal are all mounted on a single plate. Rear and front binding pairs may also be mounted on the plate.

BRIEF DESCRIPTION OF DRAWINGS

The above objects, characteristics and advantages as well as others will appear more clearly from the detailed description which follows, given by way of non-limiting refere particular embodiment, in which:

FIG. 1 shows a schematic perspective view of a nonoski brake according to the invention;

FIG. 6 is a cross sectional view of the pedal capping the stud.

FIG. 7 is a partial view of the pedal covering the stud, in perspective, and illustrates vertical guidance means of the pedal.

DESCRIPTION OF PREFERRED EMBODIMENTS

Figure 2:
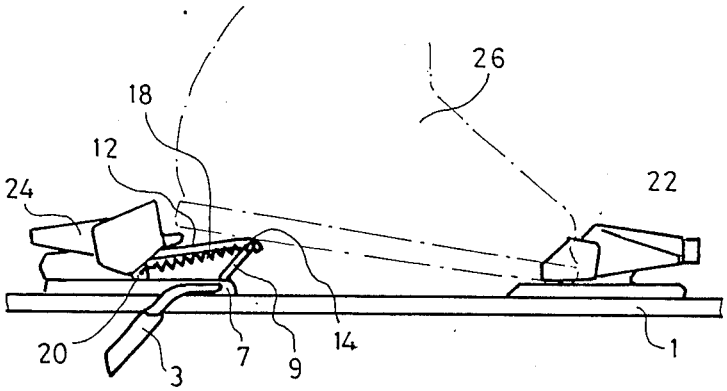
FIG. 2 illustrates a very schematic side view of a monoski brake according to the present invention associated with bindings and a boot in the course of insertion of the boot.

It is, therefore, an object of the present invention to provide a novel brake adapted for a monoski which makes it possible to overcome the three specific disadvantages noted above.

Additionally, it is a further object of the present invention to provide a novel brake system which is particularly simple to manufacture and to mount. In effect, a supplemental difficulty in the case of monoskis is that, contrary to the case of pairs of conventional skis, the widths of monoskis are not standardized and one finds monoskis of very different widths, which can vary, for example, up to twice in width, as a function of the weight of the skier and the type of performance which is expected from the monoski.

To achieve the above objectives, as well as others, the present invention provides a monoski brake comprising at least one brake element comprising a brake projection, an intermediate pivot axis and a head. The brake element is pivotably movable in a plane perpendicular to that of the monoski between an active brake position in which the brake projection projects beneath the lower plane of the monoski, and an inactive position in which the brake projection is raised above the plane of the monoski. The head remains above the upper surface of the ski in the two positions mentioned above. A monoblock pedal acts simultaneously on all of the brake elements to make them pass from the active position to the inactive position during insertion of at least one foot. Bias means are provided to bias the brake means into the active position when no boots are inserted. In this brake, the pedal comprises a frontal portion maintained against the heads of the brake means. The frontal portion extends laterally on both sides of the vertical longitudinal median plane of the monoski into the zones occupies by the boots. Thus, the pedal and the brake means are positioned and maintained in the inactive position by the positioning of either one of the two boots. The brakage element and the pedal return to the active position when the two shoes are disengaged from the binding assemblies.

The bias means comprise at least one spring attached at one end to the lower surface of the frontal portion of the pedal and attached at the other end to a stud attached to the upper surface of the monoski, on the side opposite the head.

According to one embodiment of the invention, the at least one spring is attached to the pedal along the central zone of its frontal portion. The action of the at least one spring is thus balanced and exerted in the zone which is always close to the shoe when the user engages a single shoe on the monoski. One thus reduces the imbalances and torsional constraints exerted on the pedal when the monoski is being used and operated by a single boot or shoe.

According to one embodiment of the invention, the pedal further comprises a rear central portion which rests slidably on the stud.

According to one embodiment of the present invention, the frontal portion of the pedal comprises a fold in which the heads of the brake elements are fitted. The heads are slidably mounted in the fold in the transverse direction. Such a coupling between the frontal portion of the pedal and the heads of the brake elements makes it possible to position the brake elements at variable lateral distances with respect to the pedal.

According to another aspect of the invention, the pivot axes of the brake elements are continuous and are transversely guided in sockets fixed laterally on the upper surface of the monoski.

In another embodiment of the present invention, the stud comprises means for avoiding the lifting of the rear portion of the pedal.

According to yet another embodiment of the invention, the stud and the pedal comprise complimentary engagement means which assure lateral guidance of the rear portion of the pedal.

As shown in perspective in FIG. 1, the system according to the invention is adapted to be mounted on the upper surface of a monoski 1. This system comprises brake projections 3 and 4 mounted to pivot in a substantially vertical plane around horizontal axes 5 and 6 extending through sockets 7 and 8 attached on the sides of the upper surface of the monoski. Brake projections 3 and 4 are integral with the extensions or head portions 9 and 10 such that a pivoting of these head portions 9 and 10 causes a pivoting of brake projections 3 and 4. For example, in the embodiment of FIG. 1, the brake projections and head portions 9 and 10 are formed of a single shaft configured as shown of three orthogonal segments, the median segments being horizontal and serving as a rotation shaft in socket 7.

A pedal 12 is provided which comprises a frontal portion 14 of substantial width and a rear portion 16. By substantial width, it is meant that pedal 14 has substantially the maximum width compatible with the width of a monoski of small dimension. Thus, this frontal portion occupies the entire width of a small dimension monoski and at least half the width from each side of the longitudinal axis for a ski of large dimension. This pedal is lowered when a skier places one or the other of his boots in a binding system, not shown in FIG. 1. The frontal portion 14 of pedal 12 is associated with head portions 9 and 10 of the brakage element such that pressing on this frontal portion 14 of the pedal causes braking projections 3 and 4 to lift into the inactive position.

In order that the brake projections 3 and 4 be in the active braking position when at rest, frontal portion 14 of the pedal is biased by spring 18 whose other end is attached to a stud 20 which is itself affixed in the central zone of the monoski. The rear or distal portion of pedal 16 slides freely on the upper surface of the stud.

FIG. 2 illustrates in an extremely schematic fashion the positioning of a brake system according to the invention associated with a monoski binding. In this side view it is assumed that the two bindings are positioned exactly at the same height on the monoski, behind one another, such that only a single binding is visible. The visible portions of the brake system are designated by the same reference numerals as in FIG. 1. Additionally, in FIG. 2 front abutment 22 of a binding, rear abutment 24, and a boot 26 are seen such that it is clear that insertion in the binding will result in brake projection 3 being raised. The embodiment of this Figure is given by way of example only. The Figure is not to scale and variation of dimensions of the brake system with respect to the binding dimensions and the shoe or boot are possible. Likewise, the brake apparatus can be positioned further to the front or the rear with respect to the rear binding, the only necessary condition being that the lateral ends of frontal portion 14 of pedal 12 be engaged at least partially under the location adapted to be occupied by each of the boots.

Figure 3:
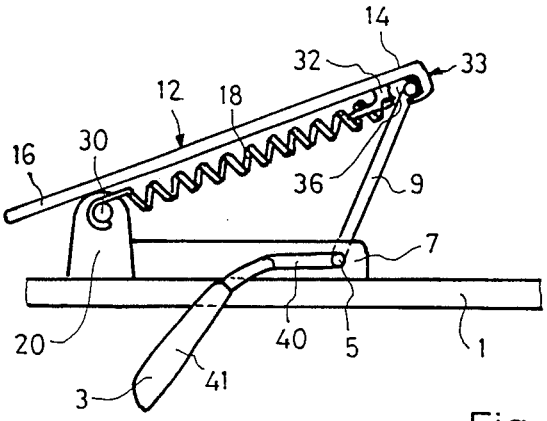
FIGS. 3 and 4 are more detailed side views of a monoski brake according to the present invention, in the braking position and in the inactive position, respectively.
Figure 4:
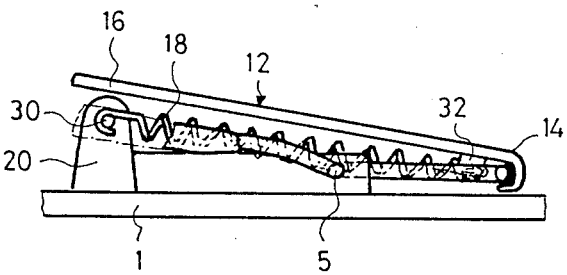
Figure 5:
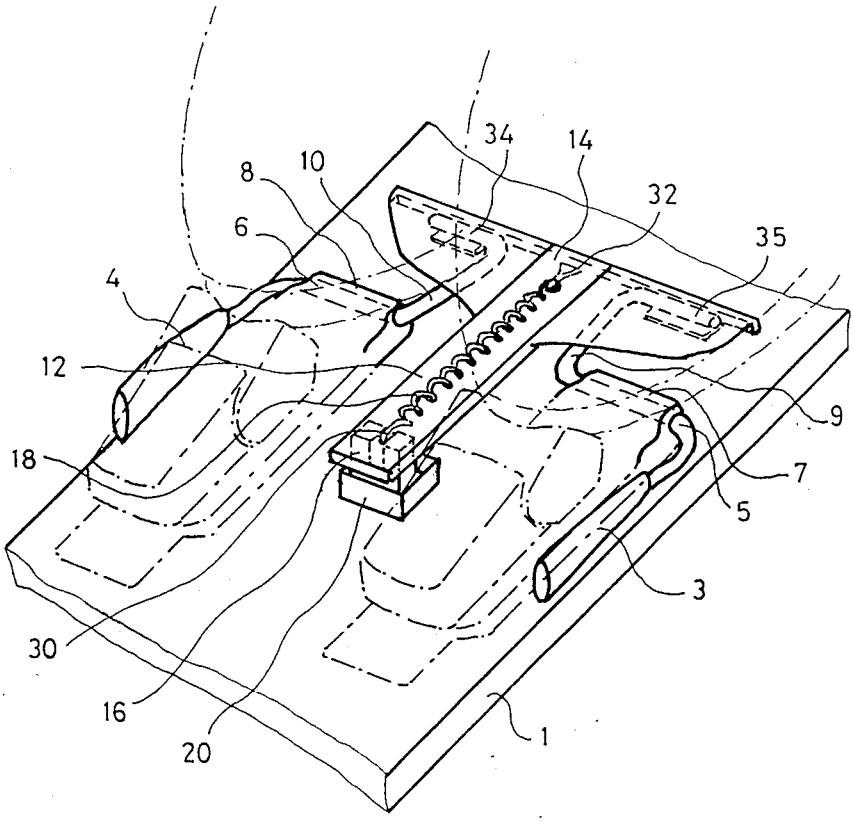
FIG. 5 is a perspective view of a monoski brake according to the embodiments of FIGS. 3 and 4.

FIGS. 3, 4 and 5 respectively illustrate a side view in the active position, a side view in the inactive position and a perspective view in the inactive position, of a brake according to the present invention mounted on a monoski. In the Figures, which represent a more detailed embodiment, the same reference numerals are utilized to designate the same elements as in FIG. 1. FIGS. 3, 4 and 5 will, therefore, not again be described in detail with respect to those elements previously described and shown.

FIG. 3 more particularly illustrates the method of attachment of spring 18, while all of these Figures illustrate the form of the brake element.

In the embodiment shown, spring 18 is attached in tension at one end to a shaft 30 (see FIGS. 3 and 5) mounted in an opening in stud 20, and at the other end to a centrally positioned spur 32 at the lower surface of pedal 12, adjacent the frontal portion. One advantage of the binding being positioned where it is shown at the rear lower end portion of pedal 12, and a bit retracted with respect to the extreme front portion 33 of the pedal, resides in the fact that in this arrangement the rear binding tends to press the distal portion 16 of pedal 12 on the upper surface of stud 20 and brings back the pedal into this support position against stud 20 in the case where it is lifted during manipulation of the skis or during removal of the boot. Normally, such an arrangement is sufficient. However, in certain particular cases, for example in the case where for practical reasons, for example ease of manufacture, one would prefer to attach one end of the springs to the frontal extreme portion of the pedal, one can provide a vertical guidance means of the rear portion, to avoid the lifting of the rear portion of the pedal.

FIG. 7 illustrates these vertical guidance means in the form of an arch 38 in the shape of an inverted C. The ends of the arch are engaged in the stud 20, and the main portion of the arch surrounds the rear portion 16 of the pedal. Thus, the pedal is vertically guided downwardly by the stud, and upwardly by the horizontal branch of arch 38.

Furthermore, it can be advantageous to provide lateral guidance means for rear portion 16 of the pedal on stud 20. Such guidance is necessary in embodiments in which heads 9, 10 can slide laterally with respect to pedal 12. For example, in the embodiment shown in the Figures, the distal portion of the pedal has an inverted-U cross-section (see FIG. 6), and caps stud 20, the lateral wings of the distal portion being fitted against the lateral surfaces of the stud (see FIGS. 1 and 5).

The lateral and/or vertical guidance can be assured, for example, by lateral slabs on both sides of stud 20, a groove in this stud, or any other means.

With respect to the configuration of the brake element, the multiple bend configuration appears clearly in FIG. 3 wherein the brake projection comprises angles defining at least one intermediate segment 40 and one end segment 41. The intermediate segment is oriented obliquely upwardly when the brake element is in the inactive position. This makes it possible, when the brake element is placed in the inactive position as in indicated in FIG. 4, that the projections be clearly lifted above the lower surface and even above the upper surface of the monoski.

Furthermore, the brake elements are bent on both sides of their intermediate portion so as to form an axis of rotation, which pivots within the lateral surfaces of sockets 7 and 8 which transversely guide the intermediate portion.

The movement of the brake elements and the pedal in the direction of the active position is limited by abutment means. For example, the abutment means can assume the form of the intermediate portion of the projections which abut against the upper surface of the monoski at the end of its extent of travel (see FIG. 3); or one can provide abutment means between the rear portion of the pedal and stud 20.

With respect to the hooking or latching of frontal portion 14 of pedal 12 with heads 9 and 10 of the brake elements, in the embodiment shown, heads 9 and 10 are constituted by a shaft bent over in a manner such that its frontal extreme portions 34 and 35 are substantially perpendicular to the axis of the monoski and are slidably mounted in a transverse fold 36 of the frontal portion 14 of the pedal, wih the pedal resting in position after traction of spring 18. This system has the advantage of great simplicity of manufacture and mounting. It furthermore makes it possible to manufacture lateral socket-brake assemblies and stud-pedal assembly elements having standardized dimensions. As was previously indicated, frontal portion 14 of pedal 12 has a width which corresponds to the smallest width possible of a monoski. By appropriately selecting the angularity of head 9 of the braking element and the width of the extreme frontal curved portion 35 of this head, one can adapt a single brake assembly to monoskis of different widths, by compensating for the variations in width of the skis by the sliding of the extreme frontal portions 34 and 35 in transverse fold 36.

In the various Figures illustrated, three distinct elements are attached to the surface of the monoski: the two sockets 7 and 8 and the stud 20. To reduce the number of holes to be made in the upper surface of the ski, one can provide for each monoski one plate, for example a metallic plate of width adapted to that of the monoski and on which the various elements are be prepositioned. This plate can likewise serve as a base for positioning of the front and rear binding abutments.

Preferably, the two sockets 7 and 8 form support surfaces on which the soles of the shoes rest. Notably, in the embodiment shown, the sockets form foot-rest plates situated immediately in front of rear abutments 24. Preferably, the sockets are traversed on both sides by the pivot axis of the brake element.

Various materials can be utilized to manufacture the brake elements according to the present invention. These elements can be metallic, or a substantial portion of them can be made of plastic material, for example sockets 7 and 8 and pedal 12. On the other hand, brake elements 3 and 4 are preferably metallic and of relatively large dimensions so as to allow for the substantial braking necessitated by the relatively substantial weight of the monoski.

Although the invention has been described with reference to particular means, materials and embodiments, it is to be understood that the invention is not limited to the particulars disclosed, particularly with respect to the materials utilized, the method of attachment of the pedal-brake element heads, the shape of the sockets, the lateral blockage of the shafts of the brake elements with respect to these sockets, etc., and extends to all equivalents within the scope of the claims.

What is claimed is:

1. A monoski brake binding combination comprising:

(a) a plurality of bindings (b) a plurality of bindings of brake elements, each of said brake elements being associated with one of said bindings and being adapted to assume an active position in which it extends downwardly below the lower plane of the monoski, and an inactive position in which it is at a level above the lower plane of the ski;

(c) inactivation means for inactivating each of said brake elements by moving said brake elements from the active position to the inactive position; and wherein said inactivation means is adapted to inactivate said plurality of brake elements simultaneously.

2. The monoski brake-binding combination as defined by claim 1 wherein each of said brake elements comprises a brake projection, and a head, and is adapted to pivot around a pivot axis, said head moving in a plane substantially perpendicular to that of the monoski on which said combination is to be mounted, and wherein in the active position said projection projects beneath the lower plane of said monoski and in the inactive position said projection is raised to at least the plane of the monoski, said heads being adapted to be positioned above the upper surface of the monoski.

3. The monoski brake-binding combination as defined by claim 2 further comprising bias means for biasing each of said brake elements towards the active position.

4. The monoski brake-binding combination as defined by claim 3 wherein said inactivation means is a common pedal associated with each of the heads of said brake elements, said common pedal comprising a frontal portion extending across the vertical longitudinal median plane of the monoski into zones to be occupied by each of the ski boots, whereby both of said brake elements are activated simultaneously only upon removal of both boots.

5. The monoski brake-binding combination as defined by claim 4 wherein said bias means comprise at least one spring attached at one end to the lower surface of said frontal portion of said pedal and at its other end to a stud adapted to be attached to the upper surface of said monoski on the side opposite said head with respect to said pivot axis.

6. The monoski brake-binding combination as defined by claim 5 wherein each of said at least one spring springs is attached to the central zone of said frontal portion of the pedal.

7. The monoski brake-binding combination as defined by claim 6 wherein said pedal further comprises a rear central portion slidably mounted on said stud.

8. The monoski brake-binding combination as defined by claim 7 wherein said stud and said rear portion of said pedal comprise complementary engagement means adapted to assure guidance of the rear central portion of the pedal.

9. The monoski brake-binding combination as defined by claim 4 wherein said heads are mounted to slide transversely in a fold in the frontal portion of said pedal whereby said braking elements may be positioned at variable lateral distances relative to said pedal.

10. The monoski brake-binding combination as defined by claim 9 further comprising sockets adapted to be laterally affixed on the upper surface of said monoski for receiving said pivot axes.

11. The monoski brake-binding combination as defined by claim 12 wherein each of said brake elements comprises an intermediate element constituting said pivot axis for the brake element, said intermediate portion extending through one of the sockets, and wherein each of said brake elements are angled on both sides of their intermediate portion to press against the lateral surfaces of said sockets so as to assure their transverse guidance.

12. The monoski brake-binding combination as defined by claim 11 wherein said brake elements each further comprise bends defining at oblique segment between the brake projection and the intermediate portion which is obliquely oriented when the brake projection is in the inactive position, such that the brake projection is lifted with respect to the surface of ski.

13. The monoski brake-binding combination as defined by claim 11 wherein each of said sockets is adapted to form a support surface on which the sole of a boot may rest.

14. The monoski brake-binding combination as defined by claim 1 mounted on a monoski.

15. The monoski brake-binding combination as defined by claim 1, comprising two brake elements, each of said brake elements being mounted on a socket, and wherein said inactivation means comprises a pedal; and wherein said two brake elements, their corresponding sockets, and said pedal are all mounted on a single plate.

16. The monoski brake-binding combination as defined by claim 15 in combination with a rear binding pair mounted on said plate.

17. The monoski brake-binding combination as defined by claim 16 further comprising a front binding pair, said front binding pair also being mounted on said plate.

* * * * *

UNITED STATES PATENT AND TRADEMARK OFFICE

CERTIFICATE OF CORRECTION

PATENT NO. : 4,759,565

DATED : July 26, 1988

INVENTOR(S) : Joel ARDUIN et al.

It is certified that error appears in the above-identified patent and that said Letters Patent is hereby corrected as shown below:

Column 3, line 33, change "nonoski" to ---monoski---.
Column 8, line 26, delete "springs".
Column 8, line 60, insert ---the--- before "ski".

Column 3, line 17, insert ---,--- after "embodiment".
Column 3, line 20, insert ---,--- after "embodiment".
Column 4, line 18, change "occupies" to ---occupied---.
Column 6, line 9, change "for" to ---such--- (3rd occurrence, end of line).
Column 6, line 10, change "example" to ---as---.
Column 6, line 41, delete "in" (2nd occurrence).
Column 7, line 13, insert ---to--- before "be".
Column 8, line 46, change "12" to ---10---

Signed and Sealed this

Seventh Day of August, 1990

*Attest:*

HARRY F. MANBECK, JR.

*Attesting Officer*

*Commissioner of Patents and Trademarks*